US006563256B1

(12) United States Patent
Zavadil et al.

(10) Patent No.: US 6,563,256 B1
(45) Date of Patent: May 13, 2003

(54) LOW WORK FUNCTION MATERIALS FOR MICROMINIATURE ENERGY CONVERSION AND RECOVERY APPLICATIONS

(75) Inventors: Kevin R. Zavadil, Bernalillo, NM (US); Judith A. Ruffner, Albuquerque, NM (US); Donald B. King, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/257,336

(22) Filed: Feb. 25, 1999

(51) Int. Cl.[7] ..... H01K 1/04

(52) U.S. Cl. ..... 313/346 DC; 313/310; 313/491; 313/633; 313/630; 313/311; 313/355

(58) Field of Search ..... 313/346 DC, 310, 313/491, 633, 630, 311, 345, 346 R, 355, 252; 252/181.1, 181.2, 181.3, 181.4, 181.5, 181.6, 181.7

(56) References Cited

U.S. PATENT DOCUMENTS

| | | | | | |
|---|---|---|---|---|---|
| 4,007,393 | A | | 2/1977 | Van Stratum et al. | 313/346 R |
| 4,373,142 | A | * | 2/1983 | Morris | 310/306 |
| 5,675,972 | A | * | 10/1997 | Edelson | 313/310 |
| 5,874,039 | A | * | 2/1999 | Edelson | 313/310 |
| 6,103,298 | A | * | 8/2000 | Edelson et al. | 427/77 |

OTHER PUBLICATIONS

Gary Fitzpatrick, et al, *Demonstration of Close–Spaced Thermionic Converters*, 1993 28$^{th}$ Intersociety Energy Conversion Engineering Conference.

Kucherov, R. Ya, et al, *Closed Spaced Thermionic Converter with Isothermic Electrodes*, 1994 29$^{th}$ Intersociety energy Conversion Engineering Conference VI, AIAA–94–3978–CP.

Gary O. Fitzpatrick, *Close–Spaced Thermionic Converters with Active Spacing Control and Heat–Pipe Isothermal Emitters*, 1996 31$^{st}$ Intersociety Energy Conversion Engineering Conference—6145.

(List continued on next page.)

*Primary Examiner*—Michael P. Stafira
*Assistant Examiner*—Roy M. Punnoose
(74) *Attorney, Agent, or Firm*—Russell D. Elliott

(57) ABSTRACT

Low work function materials are disclosed together with methods for their manufacture and integration with electrodes used in thermionic conversion applications (specifically microminiature thermionic conversion applications). The materials include a mixed oxide system and metal in a compositionally modulated structure comprised of localized discontinuous structures of material that are deposited using techniques suited to IC manufacture, such as rf sputtering or CVD. The structures, which can include layers are then heated to coalescence yielding a thin film that is both durable and capable of electron emission under thermionic conversion conditions used for microminiature thermionic converters. Using the principles of the invention, thin film electrodes (emitters and collectors) required for microconverter technology are manufactured using a single process deposition so as to allow for full fabrication integration consistent with batch processing, and tailoring of emission/collection properties. In the preferred embodiment, the individual layers include mixed BaSrCaO, scandium oxide and tungsten.

24 Claims, 1 Drawing Sheet

OTHER PUBLICATIONS

Yuri V. Nikolaev, *Close–Spaced Thermionic Converters for Power Systems*, 28$^{th}$ Intersociety Energy Conversion Engineering Conference Proceedings. IECEC 1993, Atlanta, Georgia, Aug. 8–13, 1993.

Donald B. King, et al, *Results from the Microminiature Thermionic Converter Demonstration Testing Program*, International Nuclear Safety Department, Sandia National Laboratories, Albuquerque, New Mexico; New Mexico Engineering Research Institute, Albuquerque, NM.

Sadanori Taguchi, et al, *Investigation of $Sc_2O_3$ Mixed–Matrix Ba–Ca Aluminate–Impregnated Cathodes*, IEEE Transactions on Electron Devices, vol. Ed–31, No. 7, Jul. 1984.

Jan Hasker and Co Crombeen, *Scandium Supply After Ion Bombardment on Scandate Cathodes*, IEEE Transactions on Electron Devices, vol. 37, No. 12, Dec. 1990.

J. Hasker, J. Van Esdonk and J. E. Crombeen, *Properties and Manufacture of Top–Layer Scandate Cathodes*, Applied Surface Science 26 (1986) 173–195, North–Holland, Amsterdam.

Jan Hasker, et al, *Comment on Progress in Scandate Cathodes*, IEEE Transactions on Electron Devices, vol. 36, No. 1, Jan. 1989, pp. 215–219.

S. Yamamoto, et al, *Application of an Impregnated Cathode Coated with W–$Sc_2O_3$ to a High Current Density Electron Gun*, Applied Surface Science 33/34 (1988) 1200–1207, North–Holland, Amsterdam.

Shigehiko Yamamoto, et al, *Formation mechanism of a Monoatomic Order Surface Layer on a Sc–Type Impregnated Cathode*, Japanese Journal of Applied Physics, vol. 28, No. 3, Mar. 1989, pp. 490–494.

G. Gärtner, et al, *Emission Properties of Top–Layer Scandate Cathodes Prepared by LAD*, Applied Surface Science 111 (1997) 11–17.

* cited by examiner

LOW WORK FUNCTION MATERIALS FOR MICROMINIATURE ENERGY CONVERSION AND RECOVERY APPLICATIONS

This invention was made with support from the United States Government under Contract DE-AC04-96AL85000 awarded by the U.S. Department of Energy. The Government has certain rights in this invention.

BACKGROUND OF THE INVENTION

1. Field of the Invention

This invention pertains generally to a class of materials useful in microminiature thermionic converter (MTC) applications and methods for manufacturing those materials. More specifically, this disclosure describes heterogeneous mixed phase materials having tailored electron emission properties, and methods of manufacture and deposition of those materials in a manner consistent with fabricating thin film emitters and collectors for use in MTCs. The materials exhibit low work function, emit electrons at temperatures that are low when compared with those associated with electron emission in traditional thermionic converter applications, do not require activation to temperatures beyond operational levels of microminiature devices for energy conversion and recovery, and exhibit durability and chemical stability when exposed to the atmosphere. Additionally, the materials are suited to manufacture using integrated circuit and micro-electromechanical systems fabrication techniques, and they can be used in constructing electrode structures and coatings in a single process deposition of a multi-component film that contains necessary constituents.

2. Description of the Related Art

Thermionic conversion has been studied since the late nineteenth century, but practical devices were not demonstrated until the mid-twentieth century. Thomas Edison first studied thermionic emission in 1883 but Schicter did not propose its use for conversion of heat to electricity until 1915. Although analytical work on thermionic converters continued during the 1920's, experimental converters were not reported until 1941. The Russians, Gurtovy and Kovalenko, published data that demonstrated the use of a cesium vapor diode to convert heat into electrical energy. Practical thermionic conversion was demonstrated in 1957 by Herqvist in which efficiencies of 5–10% were reached with power densities of 3–10 W/cm$^2$.

Thermionic emission depends on emission of electrons from a hot surface. Valence electrons at room temperature within a metal are free to move within the atomic lattice, but very few can escape from the metal surface. The electrons are prevented from escaping by the electrostatic image force between the electron and the metal surface. The heat from the emitting surface gives the electrons sufficient energy to overcome the electrostatic image force. The energy required to leave the metal surface is referred to as the material work function, ø. The rate at which electrons leave the metal surface is given by the Richardson-Dushman equation:

$$J=AT^2\exp(-e\phi/kT),$$

where A is a universal constant, T is the emitter temperature, k is the Boltzmann constant, and ø is the emitter work function. Large emission current densities are achieved by choosing an emitter with low work function and operating that emitter at as high a temperature as possible, with the following limitations. Very high temperature operation may cause any material to evaporate rapidly and limit emitter lifetime. Low work function materials can have relatively high evaporation rates and must be operated at lower temperatures. Materials with low evaporation rates usually have high work functions.

Choosing the correct electrode material is a key component of designing functional thermionic converters. The materials here disclosed have potential application in a wide range of thermionic conversion technologies, however they are especially suited to MTCs. An example of a class of MTCs wherein the materials of this invention find application is disclosed in a separate patent application Ser. No. 09/257,335, now U.S. Pat. No. 6,294,858 filed on the same day as the present application. That separate patent application is incorporated by reference herein in its entirety.

In all thermionic converters, once the electrons are successfully emitted, their continued travel to the collector must be ensured. Electrons that are emitted from the emitter produce a space charge in the interelectrode gap (IEG). For large currents, the buildup of charge will act to repel further emission of electrons and limit the efficiency of the converter. Two options have been considered to limit space charge effects in the IEG: thermionic converters with small interelectrode gap spacing (the close-spaced vacuum converter) and thermionic converters filled with ionized gas.

Thermionic converters with gas in the IEG are designed to operate with ionized species of the gas. Cesium vapor is the gas most commonly used. Cesium has a dual role in thermionic converters: 1) space charge neutralization and 2) electrode work function modification. In the latter case, cesium atoms adsorb onto the emitter and collector surfaces. The adsorption of the atoms onto the electrode surfaces results in a decrease of the emitter and collector work functions, allowing greater electron emission from the hot emitter. Space charge neutralization occurs via two mechanisms: 1) surface ionization and 2) volumetric ionization. Surface ionization occurs when a cesium atom comes into contact with the emitter. Volumetric ionization occurs when an emitted electron inelastically collides with a Cs atom in the IEG. The work function and space charge reduction increase the converter power output. However, at the cesium pressures necessary to substantially affect the electrode work functions, an excessive amount of collisions (more than that needed for ionizations) occurs between the emitted electrons and cesium atoms, resulting in a loss of conversion efficiency. Therefore, the cesium vapor pressure must be controlled so that the work function reduction and space charge reduction effects outweigh the electron-cesium collision effect. An example of an operational thermionic converter is that found on the Russian TOPAZ-II space reactor. These converters operate at the emitter temperatures of 1700 K and collector temperatures of 600 K with cesium pressure in the IEG of just under one torr. Typical current densities achieved are <4 amps/cm$^2$ at output voltages of approximately 0.5 V. These converters operate at an efficiency of approximately 6%. The control of cesium pressure in the IEG is critical to operating these thermionic converters at their optimum efficiency.

A variety of thermionic converters are disclosed in the literature, including close-spaced converters. (See: Y. V. Nikolaev, et al., "Close-Spaced Thermionic Converters for Power Systems", Proceedings Thermionic Energy Conversion Specialists Conference (1993); G. O. Fitzpatrick, et al., "Demonstration of Close-Spaced Thermionic Converters", 28$^{th}$ Intersociety Energy Conversion Engineering Conference (1993); Kucherov, R. Ya., et al., "Closed Space Thermionic Converter with Isothermic Electrodes", 29$^{th}$ Intersociety Energy Conversion Engineering Conference (1994); and G. O. Fitzpatrick, et al., "Close-Spaced Thermionic Converters with Active Spacing Control and Heat-Pipe Isothermal Emitters", 31st Intersociety Energy Conversion Engineering Conference (1996).) Previously demonstrated thermionic converters, however, have not been able to achieve the current densities and conversion efficiencies predicted for the present invention. Others' efforts in the field of close-space converters demonstrate that expense and difficulty arise as a result of separately manufacturing and assembling at close tolerances the converter components such as the emitter, collector and spacers. Additionally, the assembly process results in relatively large converters with spacing between the emitter and collector of up to several millimeters. A large gap spacing between the emitter and collector causes the energy conversion efficiency to drop dramatically, often necessitating Cs vapor systems even in converters otherwise designed to be "close-spaced." Such vapor systems are usually large and cumbersome, and precise control of Cs vapor pressures needed to maximize conversion efficiency (ensuring that space-charge reduction effects outweigh electron-Cs collision effect) is difficult.

Miniature thermionic converters without ionized positive vapor in the IEG offer the simplest solution to thermionic energy conversion. The small IEG size itself reduces the density of electrons in the gap (and their resulting current limiting space charge). As alluded to above, the close-spaced converter has historically been difficult to manufacture for large-scale operation due to the close tolerances (several microns or even submicron interelectrode gap size) needed for efficient operation. As demonstrated in the separate application (Attorney Docket No. SD-5987.1) referenced above, however, large scale production and operation of these close-spaced converters is now possible using IC fabrication techniques. Also, the development of low work function electrodes that use materials such as those of the present invention eliminates the need for gas adsorption to lower the electrode work functions. For the reasons described above and others, there remains an unmet need for low work function materials suited to MTC applications, traditional integrated circuit manufacturing techniques and fabrication of electrodes and coatings using a single process deposition of a multi-component film wherein emission properties can be tailored to satisfy given operational requirements. Favorable materials for such purposes should emit electrons at relatively low temperatures, should not require activation to temperatures beyond operational levels of microminiature devices for energy conversion and recovery, and should exhibit durability and chemical stability when exposed to the atmosphere.

SUMMARY OF THE INVENTION

Accordingly, an advantage of the invention is that is provides a thermionic converter electrode material formed by modulated deposition comprising mixed oxides including a thermally ionizable species, a surface complex stabilizing species and a metal.

Another advantage of the invention is that is provides a method of manufacturing thermionic converter electrodes and electrode coatings wherein the method comprises the steps of depositing adjacent to one another a plurality of individual layers each including a thermally ionizable species, a surface complex stabilizing species and a metal, and heating those layers so that the metal coalesces in a matrix of heterogeneous oxide.

Yet another advantage of the invention is that it provides electrodes including materials formed by modulated deposition and comprising mixed oxides including a thermally ionizable species, a surface complex stabilizing species and a metal.

Yet another advantage of the invention is that the heterogeneous mixed phase materials provided exhibit enhanced durability and stability in the atmosphere as compared to alkaline earth oxides alone, and the materials exhibit desirable emission characteristics without having to anneal or activate above normal operational temperatures.

These and other objects of the present invention are fulfilled by the claimed invention which employs modulated deposition of material in superimposed layers or in other tailored configurations resulting in localized discontinuous metal or oxide structures. The materials contain oxides and metal which are heated to coalescence yielding a composite structure comprising metal particles of engineered dimensions suspended in heterogeneous oxide. This structure when created using IC manufacturing processes such as rf sputtering forms a suitable coating for electrodes in thermionic conversion applications, and especially microminiature thermionic conversion applications. Various metal and mixed oxide formulations are contemplated by the invention where the mixed oxides include a thermally ionizable species such as barium and a surface complex stabilizing species such as scandium. Tungsten and the other transition metals are examples of metals suited for use with the invention. Materials manufactured using this technique exhibit durability and stability when exposed to normal atmospheric conditions.

Additional advantages and novel features will become apparent to those skilled in the art upon examination of the following description or may be learned by practice of the invention. The objects and advantages of the invention may be realized and attained by means of the instrumentalities and combinations particularly pointed out in the appended claims.

DESCRIPTION OF THE FIGURE

The accompanying drawing, which is incorporated into and forms part of the specification, illustrates an embodiment of the invention and, together with the description, serves to explain the principles of the invention.

DETAILED DESCRIPTION OF THE INVENTION

Figure 1:
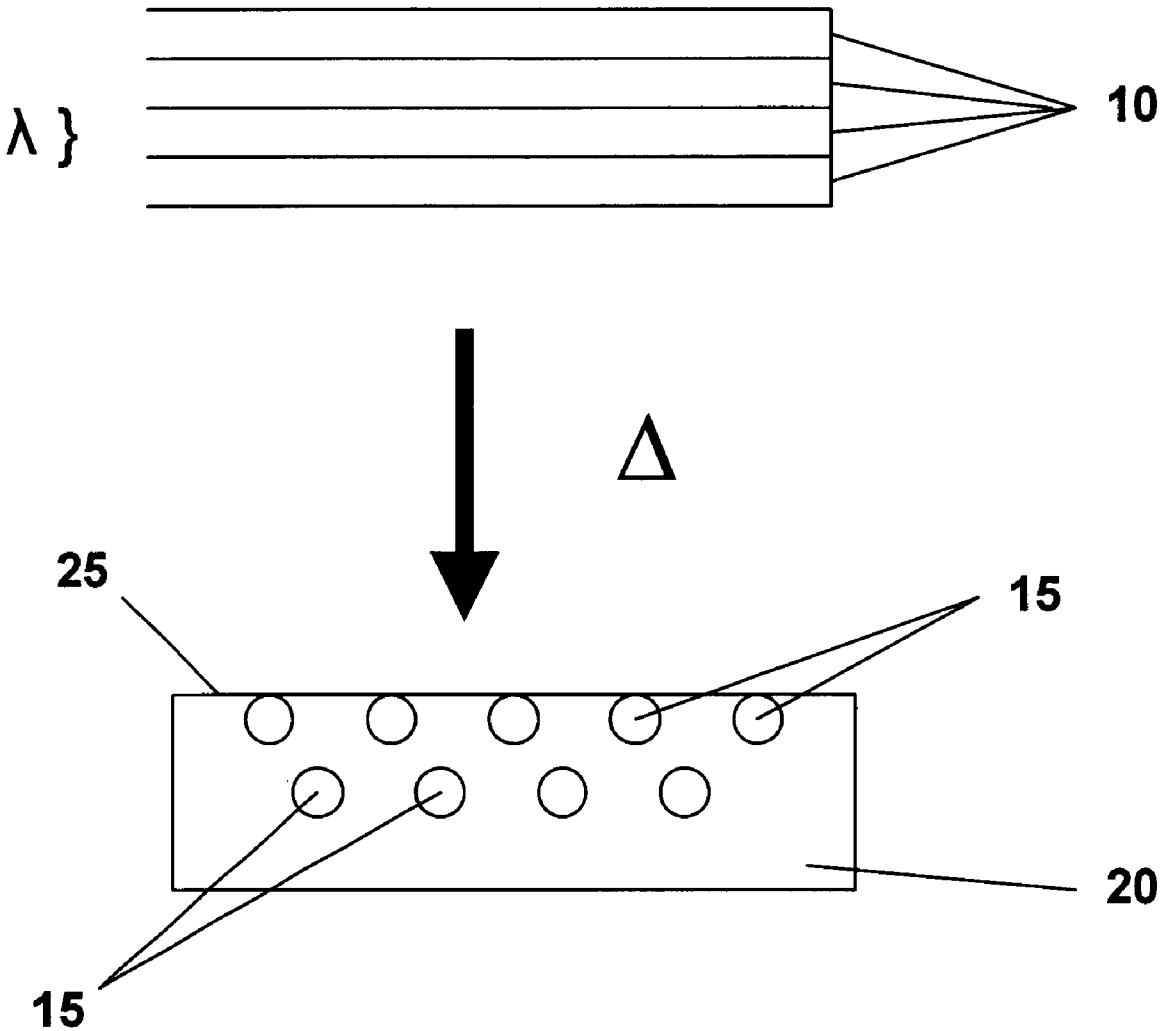
FIG. 1 is a schematic illustration of how a compositionally modulated structure of the present invention is fabricated.

The present invention concerns a compositionally modulated structure for use in thermionic converter electrodes. For purposes of this disclosure, it is recognized that an electrode comprising or bearing a coating of materials such as those described herein may function as either an anode or a cathode in a thermionic converter depending on whether it is cooled or heated. Additionally, it is recognized that modification of material work function in order to make the material suitable for an anode or a cathode can be accomplished through simple adjustments in the composition of materials used for such coatings. Given the disclosure that follows, those types of adjustments (for example, substituting different metals or oxides within the broad categories described herein) will become apparent to those skilled in the art. For this reason, unless specifically stated otherwise, if the term cathode is used in discussion of an electrode with which these materials are to be associated, such term is intended also to convey anode, and vice versa.

Planar thermionic diodes for MTCs (as disclosed in the separate application, Attorney Docket No. SD-5987.1, referenced above) can be manufactured using standard integrated circuit (IC) and micromachine (MM) fabrication techniques. All elements of the diode (emitter, collector, and insulating spacer between the electrodes) can be made using standard chemical vapor deposition (CVD) techniques and etch techniques used by the semiconductor industry. The CVD techniques allow for reliable, reproducible and accurate growth of extremely thin layers of metals (for the electrodes) and oxides (for some electrodes and for the spacers).

Existing macro-scale thermionic converter technology employs use of refractory metals such as tungsten or molybdenum to fabricate the emitter and collector electrodes. These materials have high work functions that, in turn, require higher emitter temperatures. Conversely, however, MTCs require low work function materials selected on the basis of performance criteria, and desired temperature of operation. Examples of such low work function materials that are suitable for MTC electrodes and compatible with the IC-style fabrication techniques include BaO, SrO, CaO, and $Sc_2O_3$. The present invention concerns a class of materials that includes modulated deposition of a mixture of mixed oxides that contain thermally ionizable species, a surface complex stabilizing species, and metal.

The combination of barium oxide, scandium oxide and tungsten in electron sources has been known for some time. Figner (A. Figner, A. Soloveichik and I. Judinskaya, "Metal Porous Body having Pores Filled with Barium Scandate," US Patent, 1967) developed the first of the impregnated electrode designs employing all three of these constituents. Van Stratum (A. van Stratum, J. van Os, J. R. Blatter and P. Zalm, "Barium-Aluminum-Scandate Dispenser Cathode," U.S. Pat. No. 4,007,393, 1977) incorporated scandia into the mixture of materials used to impregnate a porous tungsten body. Yamamoto (S. Taguchi, T. Aida and S. Yamamoto, IEEE Trans. Electron. Dev. 31(7), 1984, 900–903) and Hasker (J. Hasker and J. E. Crombeen, IEEE Trans. Electron. Dev. 37(12), 1990, 2589–2594) developed methods of incorporating scandium when forming the porous tungsten body. Hasker (J. Hasker, J. van Esdonk and J. E. Crombeen, Appl. Surf. Sci. 26, 1986, 173–195, J. Hasker, J. E. Crombeen, P. van Dorst, IEEE Trans. Electron. Dev. 36(1), 1989, 215f) and Yamamoto (S. Yamamoto, S. Sasaki, S. Taguchi, I. Watanabe and N. Koganezawa, Appl. Surf. Sci. 33–34, 1988, 1200–1207, S. Yamamoto, I. Watanabe, S. Taguchi, S. Sasaki and T. Yaguchi, Jpn. J. Appl. Phys. 28, 1989, 490–494) developed top-layer scandate cathodes based on an impregnated tungsten body with a scandium containing coating deposited on its surface. Finally, Gärtner (G. Gärtner, P. Geittner, H. Lydtin and A. Ritz, Appl. Surf. Sci. 111, 1997, 11–17) explored alternate methods of top-coating deposition, including plasma enhanced chemical vapor deposition and laser ablative deposition. Distinguished from this technology, however, is the present invention, which uses a single process deposition of a multi-component film that contains these key constituents.

According to the present invention, a compositionally modulated structure is deposited and then temperature-annealed to achieve the desired result. FIG. 1 illustrates schematically the preferred embodiment of how such a structure is manufactured. In this embodiment, the structure is generated by sequentially depositing superimposed separate individual layers 10 of a mixture of constituents comprising oxides and metal. These constituents in the preferred instance include a mixed BaSrCaO, scandium oxide and tungsten. It is recognized, though, that several of the transition metals may be substituted for the tungsten to yield slightly different work function characteristics in the final structure. As shown in the figure, in the preferred embodiment, the layers 10 are deposited according to a periodicity, $\lambda$. The specific size and number of the layers can be adapted by those skilled in the art according to desired end product characteristics. Favorable results have been accomplished by the inventors using thin film layers comprising tungsten and a 50:50 mixture of BaSrCaO and scandium oxide, with as few as 4 periods and up to 40 periods. Individual layer thicknesses have been varied from 10 to 100 nm. Size of the layers is a factor to be considered since the lower limit is set by how thin a film can be before it starts to nucleate to form a continuous layer. This, in turn is dependent on deposition conditions. The maximum size will be determined by a combination of atmospheric/solvent stability and time/temperature profile required to produce stable emission.

The deposition just described may be accomplished using any of the deposition techniques known to those skilled in the art of microelectronic fabrication. The preferred embodiment, however, employs the thin film technique of rf sputtering onto a suitable conducting electrode. Equally suited to the processes of the invention are any of the various forms of chemical vapor deposition (CVD), including plasma CVD and others. For purposes of this disclosure CVD is intended to encompass the general class of chemical vapor deposition, including the various specific techniques used by practitioners of that art.

After the layers are deposited, the film is heated sufficiently to cause coalescence yielding a heterogeneous oxide matrix 20 in which metal particles 15 are suspended. In the preferred embodiment wherein tungsten is used as the metal, the desired coalescence of tungsten particles in heterogeneous oxide is achieved when the film is heated to operational temperatures. The maximum temperature used by the inventors in the annealing step is 1300K, however, full activation has been demonstrated below 1000K.

Chemically, the metal particles 15 that break the surface plane 25 are supplied with barium and scandium sub-oxides via thermally activated diffusion. The metal may also play a role in making the conduction band of the oxide available for electron injection. These particles 15 become the low work function, highly electron emissive sites. Tungsten has been identified as the preferred metallic inclusion because of a demonstrated ability to control the surface composition and the modified work function. The principles described here, however, may be adapted to any metal (although transition metals are likely to yield the best results) and can include any mixed oxide system that contains a thermally ionizable species like barium and a surface complex stabilizing species like scandium.

Different deposition strategies can be developed and used depending on the desired characteristics of the electrodes or electrode thin film coatings being fabricated. For example, techniques other than just layering can be employed to yield desired localized discontinuous metal and/or oxide structures in the end product. For either thin film electrode coatings or monolithic electrodes, any of various techniques available to practitioners skilled in MEMS and IC manufacture can be of benefit in creating discrete nano and macro structures in the pre-annealed material. Such techniques include but are not limited to controlling layer thickness, masking, and selecting from various deposition modalities. When annealed, the composite structures built in this fashion can exhibit such features as metal particles of engineered dimensions.

The compositionally modulated structures just described represents an improvement over existing thermionic converter electrode materials, in part, because the structures of the present invention do not require surface finishing. Existing cathode technology involves fabricating a porous tungsten macroscopic body and impregnating it with a barium calcium aluminate, based in part on carbonate precursors. The impregnated cathode must undergo surface finishing to remove excess oxide. Additionally, activation is required at temperatures that are several hundred degrees greater that the operational window for the material. The presence of carbonate precursors results in carbon dioxide evolution and consequent instability and lack of durability. This, together with the higher activation temperatures, precludes the convenient use of such materials as micron-range emitters for microminiature energy conversion applications. Additionally, the thin film deposition techniques, such as rf sputtering or CVD, used in manufacturing the materials of the present invention, allow for deposited film uniformity which is required for the microconverter concept where a critical gap space must be generated and maintained. Film uniformity of a controlled thickness can be maintained over large areas allowing for arrays of emitters to be constructed on a single plane. This in turn makes the processes of the invention suited to batch processing of emitters. Finally, as noted above, the materials and structures of the present invention exhibit greater durability and stability in the atmosphere than many materials used in existing thermionic cathode technology. In this way, the materials of the present invention lend themselves to integration with standard microelectronic fabrication techniques such as photolithography and use of etchants and solvents.

The invention being thus described, it will be obvious that the same may be varied in many ways. Such variations are not to be regarded as a departure from the spirit and scope of the invention, and all such modifications as would be obvious to one skilled in the art are intended to be included within the scope of the appended claims.

We claim:

1. A thermionic converter electrode material comprising:

a modulated deposition of mixed oxides including a thermally ionizable species, a surface complex stabilizing species and a metal.

2. The material of claim 1 wherein the thermally ionizable species includes at least one alkaline earth oxide.

3. The material of claim 2 wherein the alkaline earth oxide includes barium.

4. The material of claim 2 wherein the thermally ionizable species includes mixed BaSrCaO.

5. The material of claim 1 wherein the surface complex stabilizing species includes scandium.

6. The material of claim 2 wherein the surface complex stabilizing species includes scandium.

7. The material of claim 3 wherein the surface complex stabilizing species includes scandium.

8. The material of claim 4 wherein the surface complex stabilizing species includes scandium.

9. A thermionic converter electrode material comprising:

a modulated deposition of mixed oxides including a thermally ionizable species, a surface complex stabilizing species and a metal, wherein the metal comprises a transition metal.

10. The material of claim 9 wherein the thermally ionizable species includes at least one alkaline earth oxide.

11. The material of claim 10 wherein the alkaline earth oxide includes barium.

12. The material of claim 10 wherein the thermally ionizable species includes mixed BaSrCaO.

13. The material of claim 9 wherein the surface complex stabilizing species includes scandium.

14. The material of claim 10 wherein the surface complex stabilizing species includes scandium.

15. The material of claim 11 wherein the surface complex stabilizing species includes scandium.

16. The material of claim 12 wherein the surface complex stabilizing species includes scandium.

17. A thermionic converter electrode material comprising: a modulated deposition of mixed oxides including a thermally ionizable species, a surface complex stabilizing species and a metal, wherein the metal comprises tungsten.

18. The material of claim 17 wherein the thermally ionizable species includes at least one alkaline earth oxide.

19. The material of claim 18 wherein the alkaline earth oxide includes barium.

20. The material of claim 18 wherein the thermally ionizable species includes mixed BaSrCaO.

21. The material of claim 17 wherein the surface complex stabilizing species includes scandium.

22. The material of claim 18 wherein the surface complex stabilizing species includes scandium.

23. The material of claim 19 wherein the surface complex stabilizing species includes scandium.

24. The material of claim 20 wherein the surface complex stabilizing species includes scandium.

* * * * *